US005996597A

United States Patent [19]

Gallo

[11] Patent Number: 5,996,597

[45] Date of Patent: Dec. 7, 1999

[54] PORTABLE DRAIN CLEANING APPARATUS AND PRESSURIZED GAS CARTRIDGE USABLE THEREWITH

[75] Inventor: Charles V. Gallo, Blacksburg, Va.

[73] Assignee: CDC Products, Inc., Blacksburg, Va.

[21] Appl. No.: 09/083,996

[22] Filed: May 26, 1998

Related U.S. Application Data

[63] Continuation-in-part of application No. 08/712,192, Sep. 11, 1996, Pat. No. 5,803,101.

[51] Int. Cl.[6] ..... B08B 9/02

[52] U.S. Cl. ..... 134/102.2; 134/169 C

[58] Field of Search ..... 134/17, 22.11, 134/22.12, 22.14, 99.2, 100.1, 102.1, 166 C, 167 C, 168 C, 169 C, 102.2; 4/255.04, 255.06, 255.09; 15/406, 407; 222/4, 5, 6; 239/309, 337

[56] References Cited

U.S. PATENT DOCUMENTS

| | | | |
|---|---|---|---|
| 1,537,313 | 5/1925 | Koudelka | 15/406 |
| 2,016,498 | 10/1935 | Hopewell | 4/256 |
| 2,284,805 | 6/1942 | Decker | 15/406 |
| 2,300,319 | 10/1942 | Smith | 4/255 |
| 2,939,154 | 6/1960 | Gasser | 4/255 |
| 3,138,803 | 6/1964 | Caplan et al. | 4/255 |
| 3,139,238 | 6/1964 | Norstrud et al. | 134/99.2 |
| 3,156,584 | 11/1964 | Yurdin | 134/17 |
| 3,280,419 | 10/1966 | Frohlich | 15/406 |
| 3,608,098 | 9/1971 | Andrisani | 4/255.04 |
| 3,707,301 | 12/1972 | Rauls | 4/255.04 |
| 3,789,861 | 2/1974 | Conn et al. | 134/166 C |
| 3,823,427 | 7/1974 | Pittet | 4/255 |
| 3,879,771 | 4/1975 | Nakane | 4/255 |
| 4,034,427 | 7/1977 | Breznock et al. | 4/255 |
| 4,059,858 | 11/1977 | Lambel et al. | 4/255 |
| 4,063,317 | 12/1977 | Santore | 4/255 |
| 4,321,712 | 3/1982 | Dixon | 4/256 |
| 4,420,852 | 12/1983 | Bowlsby | 134/166 C |
| 4,722,127 | 2/1988 | Pujol . | |
| 4,791,946 | 12/1988 | Cavanaugh et al. | 134/166 C |
| 5,029,594 | 7/1991 | Pierce, Jr. | 134/166 C |
| 5,249,311 | 10/1993 | Rau | 4/255.05 |
| 5,530,988 | 7/1996 | McQuillan | 15/406 |

*Primary Examiner*—Philip R. Coe
*Attorney, Agent, or Firm*—Everett G. Diederiks, Jr.

[57] ABSTRACT

A readily transportable, compact and self-contained drain cleaning apparatus includes a hand-held control housing provided with an internal passage into which a release valve member extends for regulating fluid flow through the passage. The control housing includes a cartridge housing portion for attaching a miniature cartridge, containing a pressurized gaseous medium and preferably either a drain cleaning or algaecide fluid, thereto with an interior of the cartridge opening into the internal passage. The cartridge housing is provided with a safety aperture for pressure relief purposes. The control housing has an elongated tubular member attached thereto through a rotatable coupling and the tubular member has an end, remote from the control housing, provided with a terminal discharge member that is adapted to be sealing engaged with an open portion of a clogged drain conduit. With this construction, shifting of the release member causes a supply of pressurized fluid from the pressurized cartridge to flow through the tubular member and terminal discharge member and into the drain conduit in order to clean the drain conduit.

16 Claims, 5 Drawing Sheets

2
47
18
73
49
45
19
25
5
63
55
60
50
15
53
8
21
29
27
31
11
126
124
70
97
105
108
100
93
83
86
111
88
80

PORTABLE DRAIN CLEANING APPARATUS AND PRESSURIZED GAS CARTRIDGE USABLE THEREWITH

This application represents a continuation-in-part of U.S. patent application Ser. No. 08/712,192 filed Sep. 11, 1996, now U.S. Pat. No. 5,803,101.

BACKGROUND OF THE INVENTION

1. Field of the Invention

The present invention pertains to the art of plumbing and, more specifically, to a portable drain cleaning apparatus that is particularly adapted for use in cleaning condensation drains associated with air conditioning and other refrigeration units, but which could also be used in other plumbing applications. The invention is further directed to a cartridge containing a pressurized gas, as well as a drain cleaner or algaecide, for use in combination with the drain cleaning apparatus.

2. Discussion of the Prior Art

Over the years numerous devices has been utilized in connection with the clearing of clogged drains. For example, it has heretofore been known to attach one end of a hose to a sink faucet and to place the other end of the hose, in a generally sealed manner, within a clogged drain in order to cause pressurized water to flow through the hose once the faucet is opened in an attempt to remove any obstructions. Unfortunately, such a simply arrangement rarely works, even on drains having relatively minor obstructions therein. In an attempt to enhance such a known system, it has also been proposed to place a container housing a drain cleaning fluid in series with the hose in order to introduce an additional cleaning enhancing substance within the clogged drain. This known prior art arrangement generally has associated therewith a level of effectiveness commensurate with simply pouring the cleaning enhancing substance directly down the drain.

Various other drain cleaning devices have also been proposed which incorporate auxiliary pressure sources. For instance, it is known to utilize a miniature gas cartridge in combination with a plunger-type drain cleaning unit to create a high pressure force to dislodge an obstruction within a drain. Actually, standard plunger-type drain cleaning units are essentially just as effective on almost all clogs experienced in these particular types of drains. In addition, such known arrangements are only useful in limited applications due to their size and overall configuration. In essence, these known arrangements are only functional in cleaning standard sink drains and toilets. One particular environment wherein such prior art arrangements are not functional is in cleaning condensate drains. The main reason why these prior art arrangements are not utilized in connection with condensation drain clogs is the inaccessibility of condensate drains in general. Usually such drains are located in confined areas in attics or basements and the inlet openings thereto are often located directly adjacent a cooling coil or other structure which provides for extremely limited access.

Because of these and other shortcomings of prior known systems, until just recently, the most common method for cleaning condensation drains, particularly in air conditioning or other types of refrigeration units, has been to force a flow of freon from a pressurized container through the clogged drain. However, with the enactment of new regulations by the Environmental Protection Agency (EPA), the use of freon-based cleaning systems has been made illegal. In the aftermath of these regulation changes, it has become commonly known to simply utilize a rather large, pressurized air or nitrogen tank having an attached hose, the free end of which can be positioned at the opening of a condensate drain conduit such that opening of a valve on the tank will force pressurized gas to be injected into the conduit. However, as indicated above, such drain conduits are often found in confined areas and the lugging of these heavy tanks is not only extremely inconvenient but sometimes dangerous. In addition, it is extremely difficult, if not impossible, to regulate or determine the exact amount of pressurized gas that is released in any given application such that the customer is generally charged for a greater percentage of the pressurized gas than is actually dispensed.

In view of the above, it should be readily apparent that there exists a need in the art of plumbing for a drain cleaning apparatus that is compact and lightweight so as to be readily portable, is designed to be easily maneuvered so it can be used in various plumbing environments and particularly in cleaning hard to access condensate drain conduits, which is cost effective to make and utilize and is consumer conscious in nature.

SUMMARY OF THE INVENTION

The present invention pertains to a portable drain cleaning apparatus including a control housing having a fluid passage in a main body portion thereof. The control housing is sized to be grasped by and easily held in a user's hand such that an extremely compact and readily transportable unit is provided. A release valve member and a regulating unit are attached to the control housing and extend into the fluid passage, preferably at spaced intervals along the length of the control housing such that a chamber is defined within the fluid passage between the release valve member and the regulating unit. A first end portion of a flexible, tubular member is attached to the control housing, downstream of the release valve member, through a rotatable coupling and a second end portion of the flexible, tubular member is provided with a terminal discharge member. A pressurized gas container is removably secured to the control housing with the interior of the container opening into the fluid passage downstream of the regulating unit.

With this arrangement, the flexibility of the tubular member and the presence of the rotatable coupling enables the terminal discharge member to be easily manipulated and positioned into a clogged drain, even condensate drain conduits which often have only a few inches of clearance between an opening of the drain conduit and additional refrigeration structure. Once the pressurized container is in place, actuation of the release member will cause a supply of pressurized fluid, delivered into the fluid chamber from the pressurized container and the regulating unit, to flow through the tubular member and to exit the terminal discharge member as a momentary burst. Meanwhile, the regulating unit, which can be manually adjustable, retards a flow of additional pressurized fluid from the pressurized fluid container into the fluid chamber.

With this construction, the drain cleaning apparatus of the invention is readily portable, can be maneuvered to access portions of clogged drain conduits even through potentially meandering paths and can be easily adjusted to control the amount of pressurized fluid that is discharged therefrom. The actual structure of the control housing, release valve member, regulating unit, tubular member, terminal discharge member and pressurized container can vary without departing from the invention. The pressurized container is preferably constituted by a miniature gas cartridge that is sized to substantially fit in the palm of a hand and which may contain, in addition to the gaseous medium, a drain cleaning fluid and/or an algaecide. The control housing also comprises in a preferred embodiment a removable cartridge housing portion which is adapted to receive the miniature cartridge and is removably attached to the main body portion, as well as a puncture element which automatically opens the interior of the cartridge to the fluid passage upon assembly of the cartridge housing to the main body portion. The cartridge housing portion is preferably provided with an aperture at a bottom thereof which enables safe release of pressurized fluid from the container in the event of a leak. In another embodiment, a mechanical connection is made directly between the control housing and the gas cartridge, with the gas cartridge itself being adapted to be directly grasped by the user for supporting the drain cleaning apparatus. The terminal discharge member is preferably constituted by an elastomeric fitting that either tapers or is expandable to be effectively sealed to the drain conduit.

Additional features and advantages of the drain cleaning apparatus constructed in accordance with the invention will become more readily apparent from the following detailed description of preferred embodiments thereof when taken in conjunction with the drawings wherein like reference numbers refer to corresponding parts in the several views.

DETAILED DESCRIPTION OF THE PREFERRED EMBODIMENTS

Figure 1:
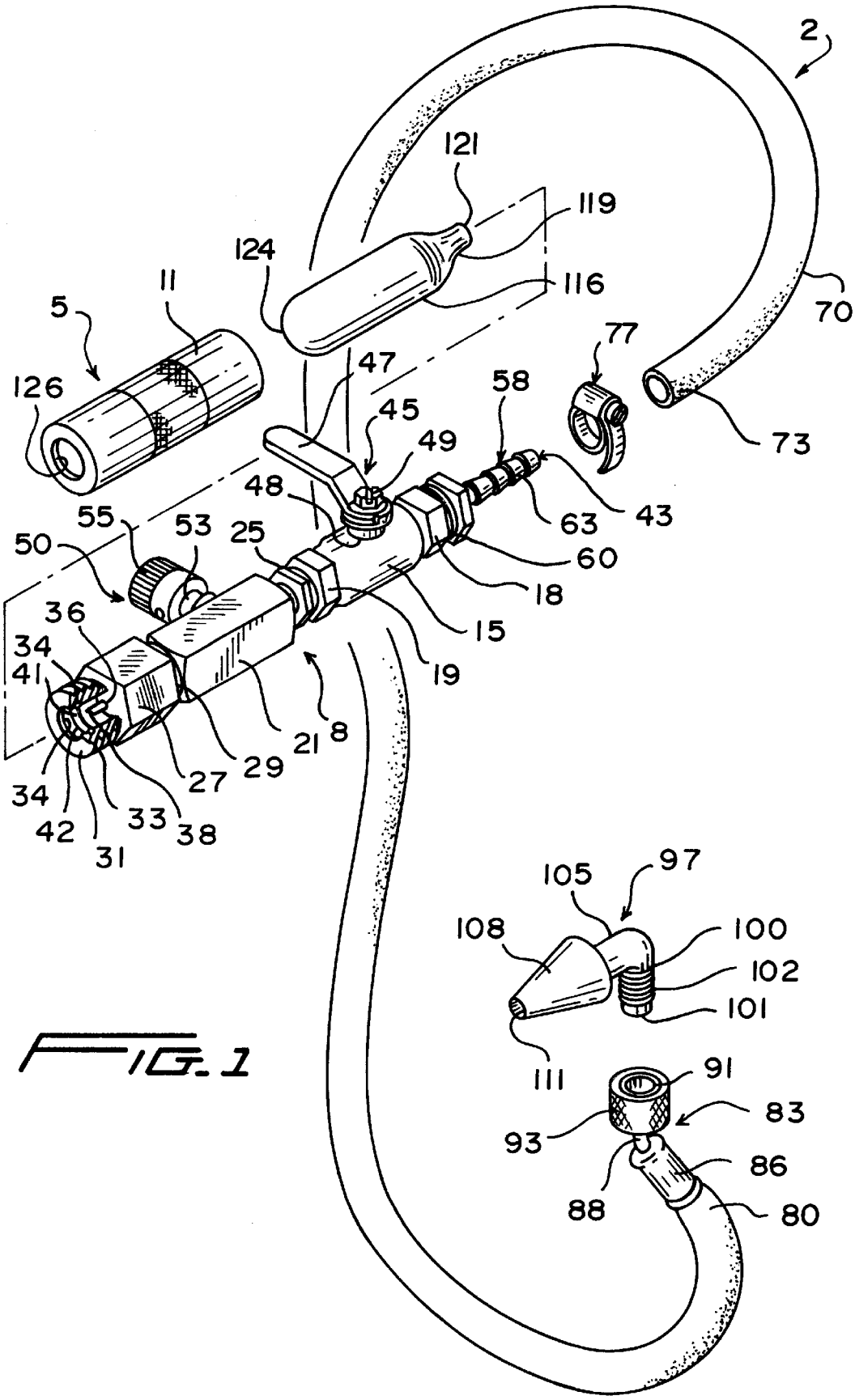
FIG. 1 is a partial exploded view of a drain cleaning apparatus constructed in accordance with a first preferred embodiment of the invention.
Figure 2:
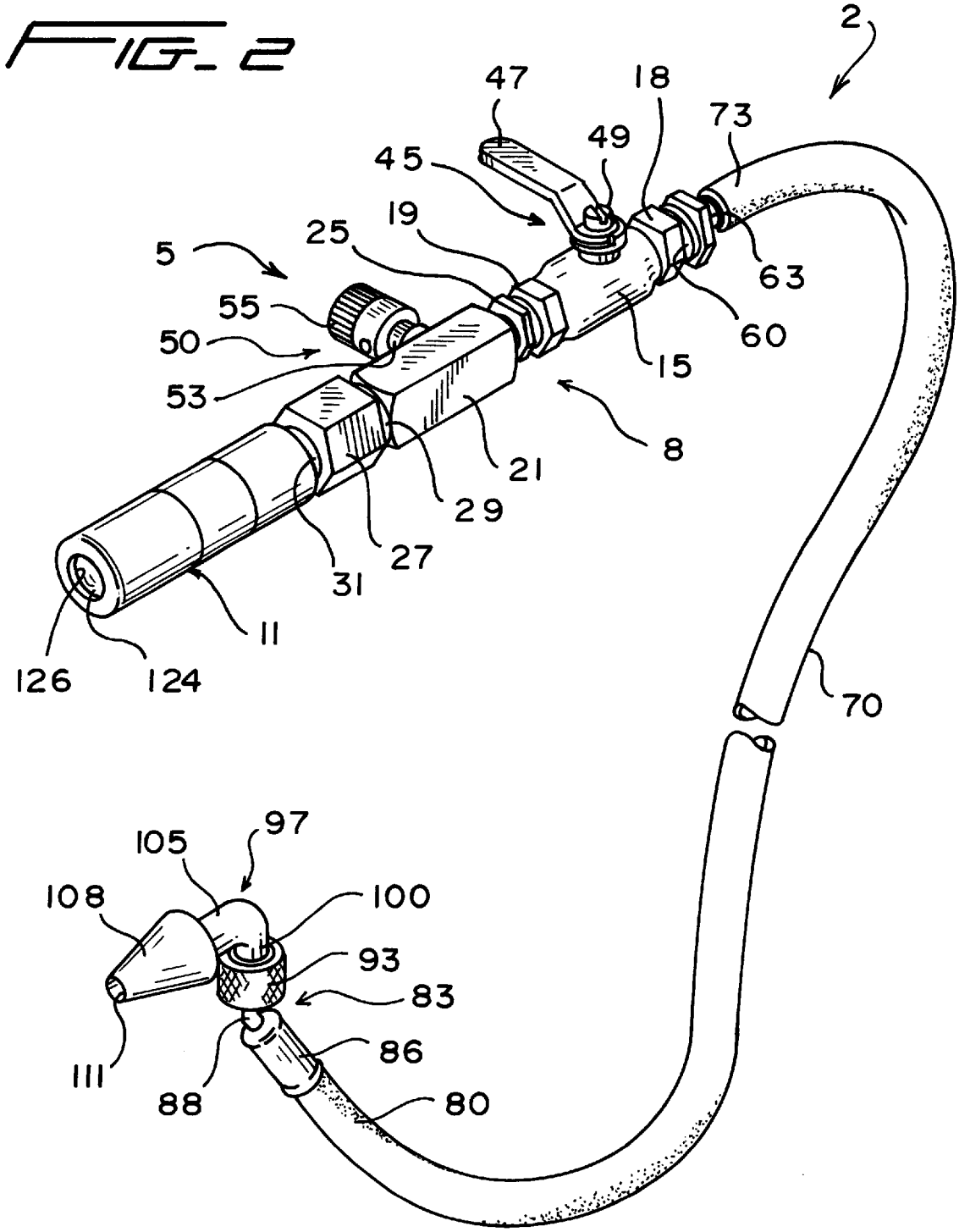
FIG. 2 is a perspective view of the drain cleaning apparatus of FIG. 1 in an assembled state.

With initial reference to FIGS. 1 and 2, the drain cleaning apparatus constructed in accordance with a first preferred embodiment of the invention is generally indicated at 2. Drain cleaning apparatus 2 includes a control housing 5 composed of a main body portion 8 and an attachable cartridge housing 11. Main body portion 8 is defined by a first section 15 having internally threaded end portions defined within integrally formed nut members 18 and 19; a second section 21 which constitutes a regulator housing section that also has internally threaded ends (not separately shown); a double-end connector 25 which threadably interconnects first and second sections 15 and 21; and a third section 27. Third section 27 has a first end 29 which is threadably or otherwise attached to second section 21 and a second end 31 that is externally threaded at 33 (see FIG. 1). Second end 31 is provided with a receiving opening 34 that leads to a puncture member 36 having a sharpened, self-piercing tip 38. Second end 31 is further provided, within receiving opening 34, with an O-ring 41 that is seated within an annular groove 42 formed within second end 31 of third control housing section 27. As will be more fully discussed below, control housing 5 has a fluid passage 43 extending there through. Therefore, puncture member 36 is tubular in construction and each of first, second and third sections 15, 21 and 27 is bored such that these elements collectively define fluid passage 43.

First section 15 carries a release valve member generally indicated at 45. In the preferred embodiment shown in these Figures, release valve member 45 constitutes a rotary valve having a manually engageable lever 47 that is attached to a stem portion 48 of the valve by means of a screw 49. Release valve member 45 is preferably constituted by an ON/OFF valve such that when release valve member 45 is in a first position as shown in these figures, fluid passage 43 is closed and therefore fluid is prevented from flowing through fluid passage 43. However, when release valve member 45 is rotated to a second position, fluid will be permitted to flow within fluid passage 43.

As mentioned above, second section 21 actually defines a regulator section having a regulating unit 50. Regulating unit 50 includes a regulating element (not shown) positioned within fluid passage 43, at a location spaced by a fluid chamber portion of fluid passage 43 from release valve member 45, and a rotary regulating stem 53 that is attached to the regulating element. Stem 53 has attached thereto a control knob 55 which can be manually adjusted to regulate the supply of pressurized fluid downstream thereof within fluid passage 43 as will be more fully discussed below. At this point, it should be noted that the particular type of regulating unit 50 incorporated in the drain cleaning apparatus 2 of the invention can vary. For instance, regulating unit 50 can comprise a flow regulating valve, a pressure control valve or a variable restriction without departing from the spirit of the invention. In addition, it should be noted that, although control housing 5 has been shown and described as being formed from various interconnected component sections, control housing 5 could equally be formed as a unitary housing having release member 45 and regulating unit 50 simply mounted thereto. The preferred embodiment presented in the drawings advantageously illustrates a form of the invention which can be readily assembled from existing parts. For example, in the embodiment shown in these figures, release valve member 45 comprises a TEEL or SPEEDAIRE ball-type gate valve and regulating unit 50 comprises a readily available PARKER flow control valve.

Attached to first section 15 of control housing 5, at an end remote from second section 21, is a terminal connector 58. More specifically, terminal connector 58 includes a threaded end 60 received within internally threaded nut member 18 and a barbed end 63, both of which function to extend fluid passage 43. Drain cleaning apparatus 2 also includes a flexible tubular member or hose 70 having a first end portion 73 attached to control housing 5 through barbed end 63 of terminal connector 58, as well as perhaps a clamp 77 as at least indicated in FIG. 1, and a second end portion 80. Second end portion 80 of tubular member 70 has secured thereto an terminal connector 83. More specifically, terminal connector 83 includes a first attachment section 86 which receives and is crimped to second end portion 80, an angled tube 88 that interconnects first attachment section 86 with a second attachment section 91 and a rotary connector 93. Although not clearly shown in the drawings, rotary connector 93 can slide along second attachment section 91 and is internally threaded. In addition, an outer surface portion (not separately labeled) of rotary connector 93 is gnarled to aid in gripping the same.

Drain cleaning apparatus 2 further includes a terminal discharge member 97. In the preferred embodiment shown in FIGS. 1 and 2, terminal discharge member 97 includes a first leg 100 having an inlet 101 and external threads 102, a second leg 105 that is preferably angled with respect to first leg 100 and which leads to a generally conical end fitting 108. End fitting 108 is formed with an outlet 111 which is in fluid communication with fluid passage 43 through terminal discharge member 97 and tubular member 70 when drain cleaning apparatus 2 is fully assembled.

Cartridge housing 11 is adapted to receive a cartridge 116 that is sized to substantially fit in the palm of a hand and which is pre-charged with a fluid medium. As shown, cartridge 116 has a tapered end 119 which terminates in a sealed tip 121. Cartridge 116 is adapted to be placed within housing 11 with a rounded bottom portion 124 of cartridge 116 being generally seated within an aperture 126 formed in a bottom of cartridge housing 11. Aperture 126 not only enables the presence or absence of cartridge 116 to be readily determined, but also aids in centering cartridge 116 in housing 11. Once cartridge 116 is positioned within cartridge housing 11, housing 11 can be mated with threads 33 provided on third section 27 of control housing 5. Tightening of cartridge housing 11 will cause O-ring 41 to seal about tapered end 119 and puncture member 36 to pierce sealed tip 121. This will cause the fluid medium to flow from cartridge 116 into fluid passage 43 and towards release valve member 45 at a rate controlled by regulating unit 50. Assuming that release valve member 45 is closed, the fluid chamber defined in fluid passage 43 between release valve member 45 and regulating unit 50 will become fully charged from the supply of fluid medium. At this point, drain cleaning apparatus 2 is ready for use.

During use, control housing 5 is adapted to be grasped by and held in one hand while terminal discharge member 97 is maneuvered into a desired position at an opening of a clogged drain conduit. Preferably, terminal discharge member 97 is formed from a relatively soft elastomeric material to aid in sealing terminal discharge member 97 relative to the drain conduit. Given the relative proximity between release valve member 45 and regulating unit 50 (for example, approximately two inches apart), both of these control elements can be easily manipulated. Once properly positioned and adjusted, shifting of release valve member 45 from the closed position to an open position will cause the pressurized fluid medium located in the fluid chamber to enter the drain conduit through the terminal discharge member 97 as a momentary burst of pressurized fluid. Meanwhile, regulating unit 50 will retard the flow of additional pressurized fluid from cartridge 116 into fluid passage 43. The degree to which regulating unit 50 retards this flow is selectively controlled by the operator through the manipulation of control knob 55. Therefore, the operator can open regulating unit 50 all the way and permit the entire contents of cartridge 116 to be released or can essentially close off cartridge 116 following the filling of the fluid chamber between release valve member 45 and regulating unit 50 to preserve the number of cleaning fluid bursts that can be obtained from a single cartridge 116.

Figures 3, 4:
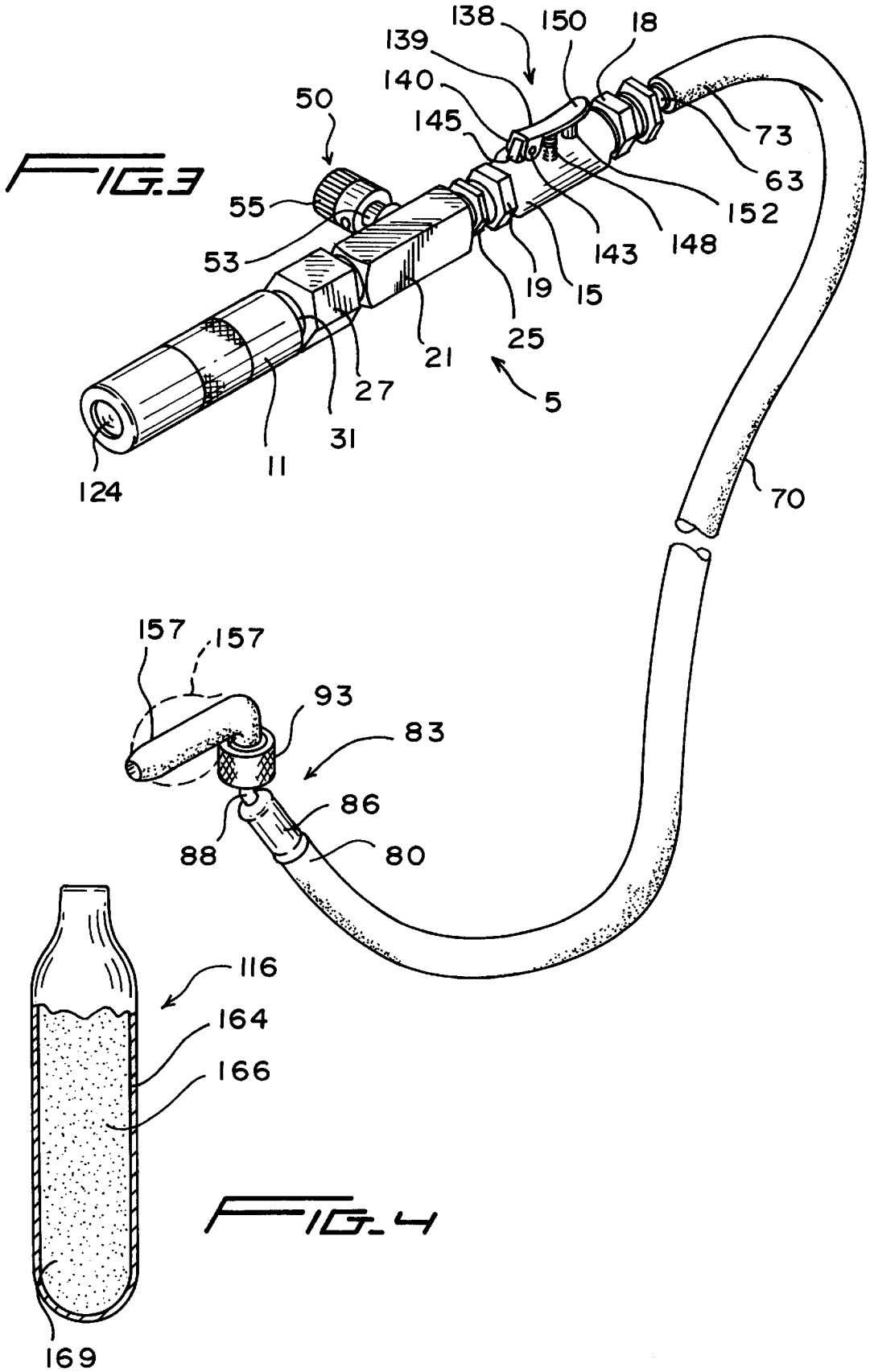
FIG. 3 is a perspective view of a drain cleaning apparatus constructed in accordance with a second preferred embodiment of the invention.
FIG. 4 is a partial cross-sectional view of a miniature pressurized cartridge adapted for use with the drain cleaning apparatuses of FIGS. 1–3.

FIG. 3 illustrates another preferred embodiment constructed in accordance with the present invention. In general, this embodiment only differs from the embodiment of FIGS. 1 and 2 with respect to the construction of the release valve member and the terminal discharge member. As shown in FIG. 3, the release valve member is constituted by a push button-type actuator 138 including a push button element 139 having a bifricated end 140 that is pivotally connected through a pin 143 to a mounting block 145 formed on control housing 5. As shown, push button element 139 is biased by a spring 148 to a position which closes fluid passage 43 and includes a cantilevered end 150 that can be manually depressed to control a valve shifting member 152 to open fluid passage 43. In this embodiment, the terminal discharge member includes an expandable bladder section 157 which will automatically expand, commensurate with the flow of a pressurized fluid medium there through, to create an effective seal with the conduit to be cleaned. Since this embodiment of the invention functions in an identical manner to the prior disclosed embodiment, this description will not be reiterated here.

FIG. 4 illustrates a preferred embodiment for cartridge 116. Cartridge 116 is preferably made of metal, although polymer materials could also be used, and has a relatively thin outer wall 164. As indicated above, cartridge 116 is pre-charged with a gaseous medium 166. The particular charging pressure could vary in accordance with the invention depending on the particular environment of use but, in general, cartridge 116 is pre-charged in the order of 800 psi. Furthermore, in accordance with the invention, cartridge 116 may contain, in addition to the gaseous medium 166 which could be carbon dioxide for example, a drain cleaning or algaecide substance as indicated at 169. Preferably, the drain cleaning or algaecide substance 169 would be in liquid form and would be atomized so as to be entrained within the gaseous medium 166 in a manner analogous to pre-charged perfume spray containers. The presence of drain cleaning or algaecide substance 169 will assure that the clogged drain is not only cleared but is treated against future occurrences.

Figure 5:
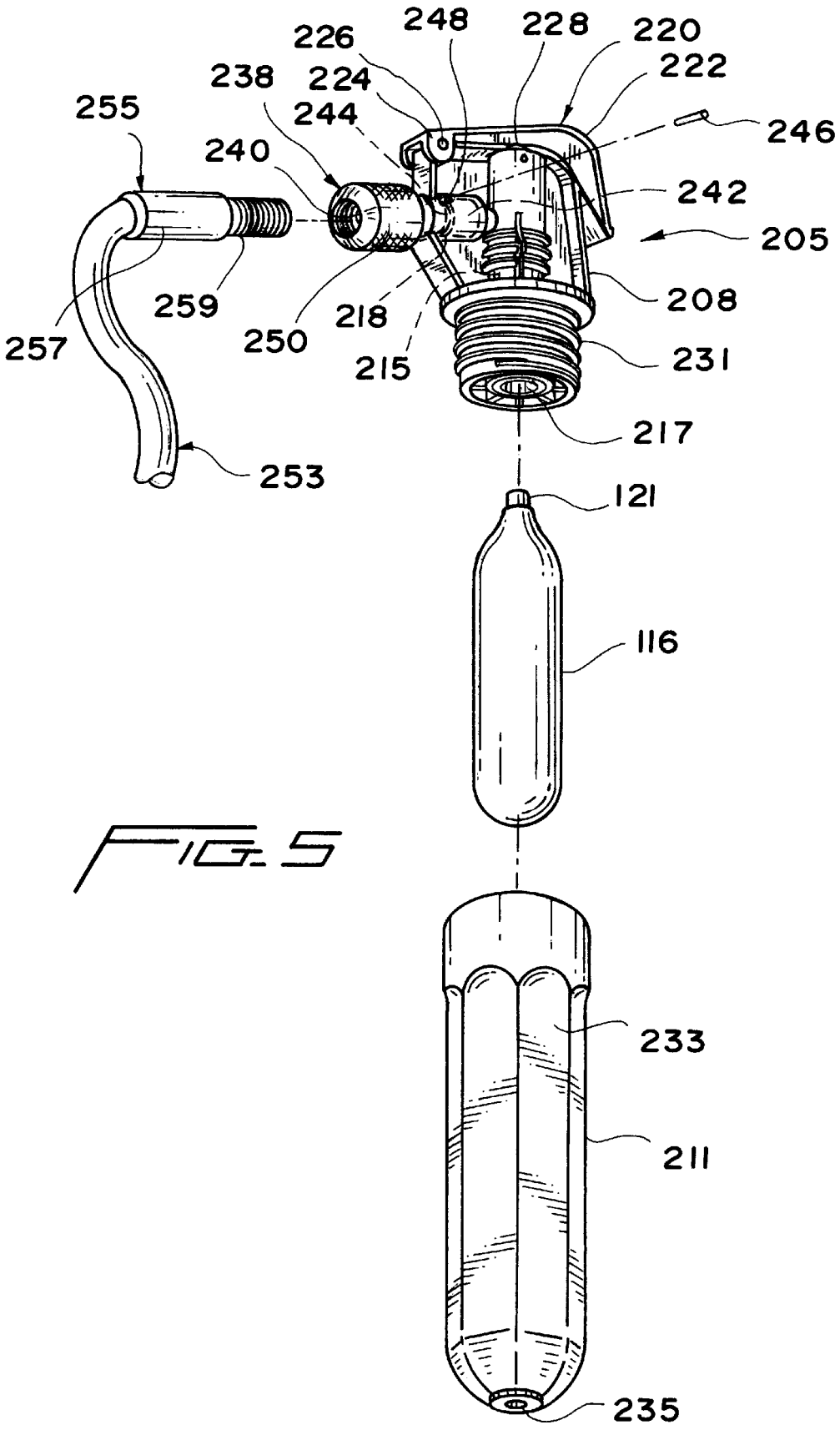
FIG. 5 is a partial exploded view of a drain cleaning apparatus constructed in accordance with a third preferred embodiment of the invention.

FIG. 5 depicts another preferred embodiment of the drain cleaning apparatus of the present-invention which includes a control housing 205 molded of plastic. More specifically, control housing 205 includes a main body portion 208 and a cartridge housing portion 211. Main body portion 208 is formed with an internal fluid passage 215 that is generally T-shaped. Fluid passage 215 defines an inlet section 217 and an outlet section 218. A release valve unit, generally indicated at 220, includes a pivotable push button release member 222 having a bifurcated end 224 which rotatably mounts release member 222 to a pair of stub shafts, one of which is indicated at 226, formed as part of main body portion 208. Release valve unit 220 also includes a linear valve element 228 which projects into fluid passage 215 in order to selectively regulate the fluid interconnection between inlet and outlet sections 217 and 218. It should be noted that the internal construction of release valve unit 220 can take various forms in accordance with the present invention, all of which forms would be well known to one of ordinary skill in the art. In accordance with the preferred embodiment, linear valve element 228 is spring biased upward into engagement with push button release member 222 and generally constitutes a spool valve.

The lower section of main body portion 208 is externally threaded at 231 for receiving cartridge housing portion 211. More specifically, it should be understood that cartridge housing 211 is adapted to receive pressurized cartridge 116 and is internally threaded at an upper portion thereof in order to secure cartridge housing 211 to main body portion 208, while simultaneously causing seal tip 121 of cartridge 116 to extend into inlet section 217 where it is punctured in a manner directly corresponding to that described above with respect to puncture member 36 and piercing tip 38. In the preferred embodiment shown, cartridge housing 211 includes various facets 233 and is provided with a reinforced aperture 235 at a lowermost portion thereof. Aperture 235 actually performs various functions in accordance with the present invention. For instance, aperture 235 can be used to verify the presence or absence of cartridge 116. In addition, should any leak develop between cartridge 116 and main body portion 208, aperture 235 will act as a pressure relief opening. The presence of aperture 235 is considered particularly advantageous given that control housing 205 in accordance with this embodiment is formed of plastic and due to the relatively high pre-charge pressure associated with cartridge 116.

This embodiment also advantageously incorporates a rotatable coupling 238 which is provided with an internal conduit 240 that is in fluid communication with outlet section 218 of fluid passage 215. More specifically, coupling 238 includes a first end 242 which extends into a receiving opening (not labeled) formed in main body portion 208. First end 242 includes a grooved section 244 as clearly shown in this figure. Coupling 238 is interconnected to main body portion 208 by means of a pin 246 that extends through a bore 248 formed in main body portion 208. Pin 246 actually projects across grooved section 244 so as to prevent longitudinal movement of coupling 238 relative to main body portion 208 while accommodating relative rotation.

Coupling 238 preferably includes a second end 250 which defines a knurled knob adapted to be connected to a tubular member 253. In general, tubular member 253 functions identical to that of the embodiments described above and therefore is provided with a similar terminal discharge member arrangement. Due to these similarities, this end of tubular member 253 is not shown in FIG. 5. However, in accordance with this embodiment, tubular member 253 is shown to include a fitting 255, preferably made of brass, that includes a crimped sleeve portion 257 and an externally threaded end 259. End 259 is adapted to be threadably secured to coupling 238.

With this construction, coupling 238 enables flexible tubular member 253 to be more easily maneuvered without developing a kink during use of the drain cleaning apparatus. Again, this can be particularly important given the working environment for this apparatus. In any event, once properly positioned for use, push button release member 222 need merely be depressed, such as by the thumb of a user, to cause pressurized fluid to flow from cartridge 126 through fluid passage 215, internal conduit 240 and through tubular member 253.

Figure 6:
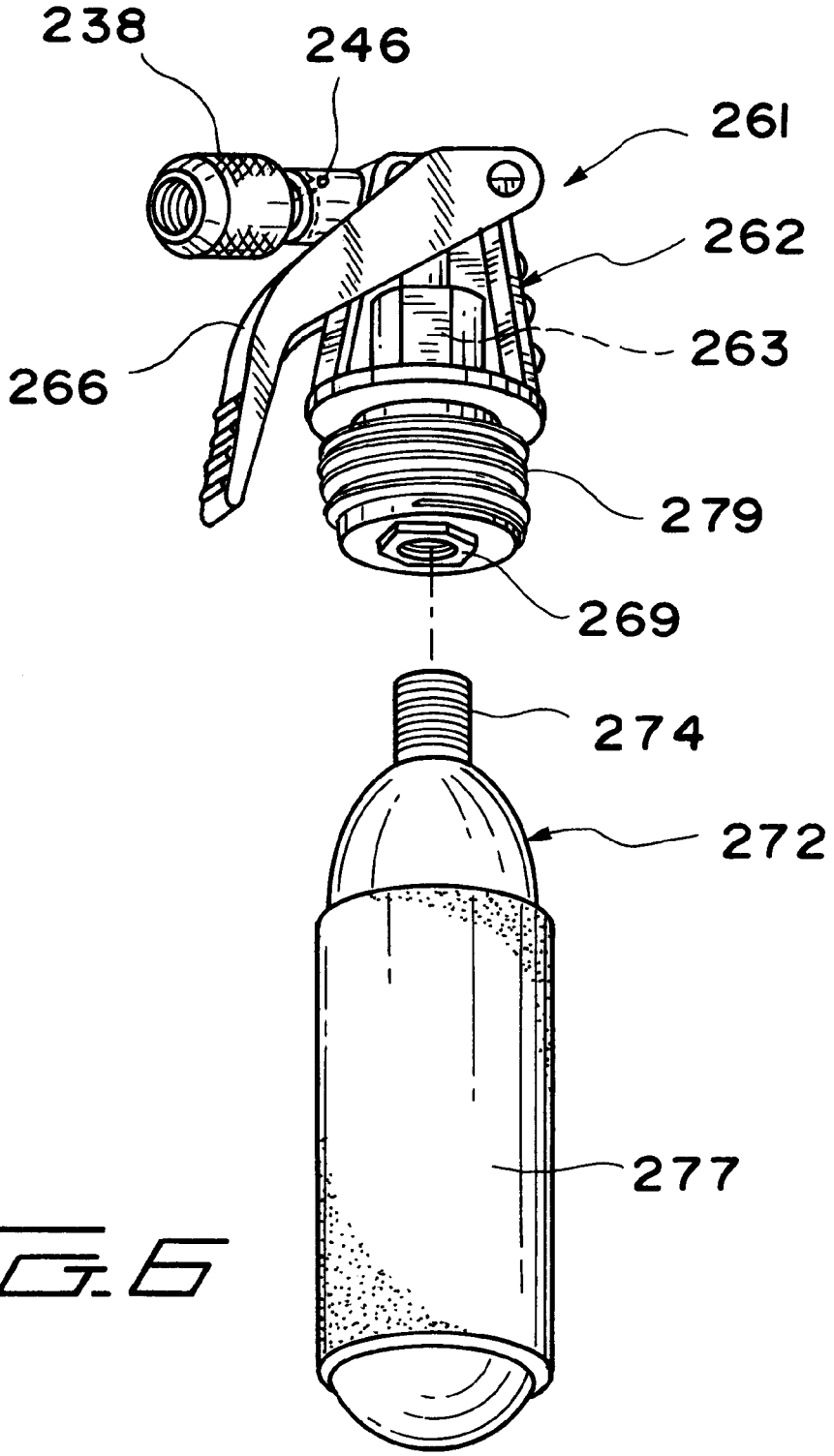
FIG. 6 is a partial exploded view of a drain cleaning apparatus constructed in accordance with a fourth preferred embodiment of the invention.

FIG. 6 represents a still further embodiment of the present invention, including a control housing 261 having a main body portion 262 that is formed with a generally L-shaped internal fluid passage 263. This embodiment differs from the embodiment of FIG. 5 in a few respects as will be detailed below. First of all, a trigger-type of release valve unit 266 is incorporated in this embodiment. In addition, the inlet section for main body portion 262 is provided with an internally threaded fitting 269, preferably formed of brass, which is adapted to threadably receive a pre-charged cartridge 272. More specifically, cartridge 272 is formed with an externally threaded discharge end 274 which can be selectively secured within fitting 269. In the embodiment shown, cartridge 272 is formed slightly larger than cartridge 116 and is provided with an elastomeric, sleeve-like gripping element 277. Therefore, in accordance with this embodiment, cartridge 272 itself would be positioned in the palm of the hand of a user and an index finger or the like of the user would be utilized to activate the trigger-type release valve unit 266. As also shown, a main body portion 262 can also have external threads 279 if it is desired to attach a cartridge housing portion 211 corresponding to that of FIG. 5. Of course, as should be recognized, if control housing 261 is used exclusively with cartridges 272 formed with threaded discharge ends 274, external threads 279 are not necessary. In addition, it should be recognized that this Figure indicates the inclusion of a corresponding coupling 238 to that described above which would be threadably attached to a corresponding tubular member 253 that is not shown in this Figure for the sake of simplicity.

From the above description, it should be readily apparent that the drain cleaning apparatus of the invention is compact, cost effective and advantageously useable in numerous environments. Although described with respect to preferred embodiments of the invention, it should be readily understood that various changes and/or modifications can be made to the invention without departing from the spirit thereof. For example, the pressurizing fluid source need not be limited to a miniature, pre-charged cartridge, but could comprise other pressurizing sources such as, for example, a small hand pump provided at the end of the control housing in place of the cartridge housing. In general, the invention is only intended to be limited by the scope of the following claims.

I claim:

1. A portable drain cleaning apparatus comprising:

a control housing adapted to be held by a user, said control housing being provided with a fluid passage having an inlet and an outlet;

a release valve member arranged to control fluid flow within said passage, said release valve member being movable between at least a first position wherein said release valve member prevents fluid from flowing within said passage and a second position wherein fluid is permitted to flow therein;

a coupling attached for relative rotation to the control housing during use, said coupling including an internal conduit in fluid communication with the outlet of the passage;

a flexible, tubular member having first and second end portions, the first end portion of said tubular member being attached to said coupling, downstream of said release valve member, such that the tubular member can rotate relative to the control housing through the coupling, with an interior of said tubular member opening into said internal conduit;

a terminal discharge member provided at the second end portion of said tubular member, said terminal discharge member being adapted to be sealingly engaged with an open end of a drain conduit and including an outlet opening in fluid communication with said internal conduit through said tubular member; and means for pressurizing said fluid passage upstream of said release valve member, wherein placement of said terminal discharge member at the open end of a drain conduit and shifting of said release valve member from said first position to said second position causes pressurized fluid in said passage to flow through said tubular member and into the drain conduit in order to clean the drain conduit.

2. The drain cleaning apparatus according to claim 1, wherein said pressurizing means comprises a cartridge that is pre-charged with a gaseous medium.

3. The drain cleaning apparatus according to claim 2, wherein the cartridge is sized to substantially fit in the palm of a hand.

4. The drain cleaning apparatus according to claim 3, wherein said control housing includes a main body portion and a cartridge housing portion, said cartridge housing portion being adapted to receive at least a portion of said cartridge and be removably attached to said main body portion, said main body portion including a puncture member adapted to puncture said cartridge when said cartridge housing is secured to said main body portion.

5. The drain cleaning apparatus according to claim 4, wherein said cartridge housing portion is formed with a pressure relief aperture.

6. The drain cleaning apparatus according to claim 3, wherein the cartridge is adapted to be directly, securely attached to the control housing.

7. The drain cleaning apparatus according to claim 6, wherein the cartridge is removably, threadably attached to the control housing.

8. The drain cleaning apparatus according to claim 6, further comprising at least one gripping element provided on an outer surface of the cartridge.

9. The drain cleaning apparatus according to claim 2, wherein said cartridge contains, in addition to said gaseous medium, at least one of a drain cleaning fluid and an algaecide.

10. The drain cleaning apparatus according to claim 1, wherein said release valve member comprises a spring-biased, push button valve unit.

11. The drain cleaning apparatus according to claim 1, wherein said release valve member comprises a trigger operated valve unit.

12. A portable drain cleaning apparatus comprising:

a flexible, tubular member having first and second end portions;

a pressurized container having a discharge end;

a control housing including a main body portion provided with a fluid passage which is in fluid communication with the first end portion of the tubular member and a housing portion adapted to be removably attached to the main body portion, said housing portion being formed with an open end section sized to receive the pressurized container, said housing portion being further formed with a pressure relief aperture;

a release member interposed between the discharge end of said pressurized container and the second end portion of said tubular member, said release member being shiftable between a closed position wherein pressurized fluid is prevented from flowing through said tubular member and an open position wherein pressurized fluid is permitted to flow through said tubular member; and a terminal discharge member attached at the second end portion of said tubular member, said terminal discharge member being adapted to be sealingly engaged at an open end of a drain conduit, wherein placement of said terminal discharge member at the open end of a drain conduit and shifting of the release member from the closed position to the open position causes pressurized fluid to flow through the tubular member and into the drain conduit in order to clean the drain conduit.

13. The drain cleaning apparatus according to claim 12, wherein said pressurized container comprises a cartridge which is pre-charged with a gaseous medium.

14. The drain cleaning apparatus according to claim 13, wherein the cartridge is sized to substantially fit in the palm of a hand.

15. The drain cleaning apparatus according to claim 13, wherein said cartridge contains, in addition to said gaseous medium, at least one of a drain cleaning fluid and an algaecide.

16. The drain cleaning apparatus according to claim 12, further comprising: a coupling attached for relative rotation to the control housing, said coupling including an internal conduit fluidly interconnecting the fluid passage and the tubular member.

* * * * *

US005996597C1

(12) EX PARTE REEXAMINATION CERTIFICATE (6147th)

United States Patent
Gallo

(10) Number: US 5,996,597 C1
(45) Certificate Issued: Mar. 11, 2008

(54) PORTABLE DRAIN CLEANING APPARATUS AND PRESSURIZED GAS CARTRIDGE USABLE THEREWITH

(75) Inventor: Charles V. Gallo, Blacksburg, VA (US)

(73) Assignee: Diversitech Corporation, Decatur, GA (US)

Reexamination Request:
No. 90/007,354, Dec. 22, 2004

Reexamination Certificate for:

| | |
|---|---|
| Patent No.: | **5,996,597** |
| Issued: | **Dec. 7, 1999** |
| Appl. No.: | **09/083,996** |
| Filed: | **May 26, 1998** |

Related U.S. Application Data

(63) Continuation-in-part of application No. 08/712,192, filed on Sep. 11, 1996, now Pat. No. 5,803,101.

(51) Int. Cl.
*B08B 9/00* (2006.01)

(52) U.S. Cl. ..... 134/102.2; 134/169 C

(58) Field of Classification Search ..... None
See application file for complete search history.

(56) References Cited

U.S. PATENT DOCUMENTS

| | | | | | |
|---|---|---|---|---|---|
| 1,537,313 | A | * | 5/1925 | Koudelka | 15/316.1 |
| 1,745,923 | A | | 2/1930 | Frizell | |
| 1,836,101 | A | | 12/1931 | Young | |
| 2,016,498 | A | * | 10/1935 | Hopewell | 4/255.07 |
| 2,021,603 | A | | 11/1935 | Kelley et al. | |
| 2,048,852 | A | | 7/1936 | Dumas | |
| 2,284,805 | A | * | 6/1942 | Decker | 15/406 |
| 2,300,319 | A | * | 10/1942 | Smith | 4/255.01 |
| 2,939,154 | A | * | 6/1960 | Gasser | 4/255.01 |
| 3,138,803 | A | * | 6/1964 | Caplan et al. | 4/255.01 |
| 3,139,238 | A | * | 6/1964 | Norstrud et al. | 239/310 |
| 3,156,584 | A | * | 11/1964 | Yurdin | 134/17 |
| 3,189,934 | A | | 6/1965 | Steinwedel | |
| 3,280,419 | A | * | 10/1966 | Frohlich | 15/406 |
| 3,426,774 | A | | 2/1969 | Conn | |
| 3,608,098 | A | * | 9/1971 | Andrisani | 4/255.04 |
| 3,707,301 | A | * | 12/1972 | Rauls | 285/9.2 |
| 3,789,861 | A | * | 2/1974 | Conn et al. | 134/166 C |
| 3,823,427 | A | * | 7/1974 | Pittet | 4/255.01 |
| 3,879,771 | A | * | 4/1975 | Nakane | 4/255.01 |
| 4,034,427 | A | * | 7/1977 | Breznock et al. | 4/255.01 |
| 4,059,858 | A | * | 11/1977 | Lambel et al. | 4/255.01 |
| 4,063,317 | A | * | 12/1977 | Santore | 4/255.01 |
| 4,321,712 | A | * | 3/1982 | Dixon | 4/255.04 |
| 4,420,852 | A | * | 12/1983 | Bowlsby | 15/104.33 |
| 4,722,127 | A | * | 2/1988 | Pujol | 29/890.031 |
| 4,791,946 | A | * | 12/1988 | Cavanaugh et al. | 134/99.1 |
| 5,029,594 | A | * | 7/1991 | Pierce, Jr. | 134/102.2 |
| 5,249,311 | A | * | 10/1993 | Rau | 4/255.05 |
| 5,287,564 | A | | 2/1994 | Davenport | |
| 5,351,710 | A | | 10/1994 | Phillips | |
| 5,530,988 | A | * | 7/1996 | McQuillan | 15/406 |
| 5,544,670 | A | | 8/1996 | Phillips et al. | |
| 5,590,696 | A | | 1/1997 | Phillips et al. | |
| 5,666,690 | A | | 9/1997 | Domansky | |
| 5,787,516 | A | | 8/1998 | Davenport | |

* cited by examiner

*Primary Examiner*—Krisanne Jastrzab

(57) ABSTRACT

A readily transportable, compact and self-contained drain cleaning apparatus includes a hand-held control housing provided with an internal passage into which a release valve member extends for regulating fluid flow through the passage. The control housing includes a cartridge housing portion for attaching a miniature cartridge, containing a pressurized gaseous medium and preferably either a drain cleaning or algaecide fluid, thereto with an interior of the cartridge opening into the internal passage. The cartridge housing is provided with a safety aperture for pressure relief purposes. The control housing has an elongated tubular member attached thereto through a rotatable coupling and the tubular member has an end, remote from the control housing, provided with a terminal discharge member that is adapted to be scaling engaged with an open portion of a clogged drain conduit. With this construction, shifting of the release member causes a supply of pressurized fluid from the pressurized cartridge to flow through the tubular member and terminal discharge member and into the drain conduit in order to clean the drain conduit.

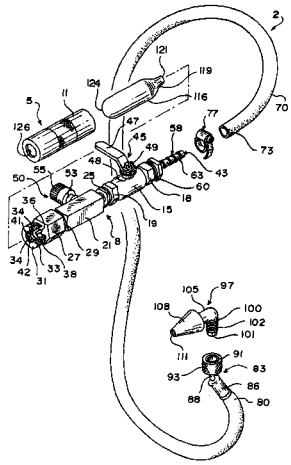

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–16 are cancelled.

* * * * *